US006701937B2

(12) United States Patent
Janouch et al.

(10) Patent No.: US 6,701,937 B2
(45) Date of Patent: Mar. 9, 2004

(54) HAIR SHAPING DEVICE, ESPECIALLY A STEAM STYLING TONG

(75) Inventors: Peter Janouch, Frankfurt (DE); Peter Lange, Eppstein (DE); Dieter Liebenthal, Maintal (DE); Silvia Rix, Schwalbach (DE); Heinz Kern, Königstein (DE); Peter Ruppert, Karben (DE); Friedrich Henninger, Kelkheim (DE); Jürgen Seng, Kelkheim (DE)

(73) Assignee: Braun GmbH (DE)

( * ) Notice: Subject to any disclaimer, the term of this patent is extended or adjusted under 35 U.S.C. 154(b) by 0 days.

(21) Appl. No.: 10/221,061

(22) PCT Filed: Mar. 8, 2001

(86) PCT No.: PCT/EP01/02605

§ 371 (c)(1),
(2), (4) Date: Sep. 9, 2002

(87) PCT Pub. No.: WO01/67917

PCT Pub. Date: Sep. 20, 2001

(65) Prior Publication Data

US 2003/0037796 A1 Feb. 27, 2003

(30) Foreign Application Priority Data

Mar. 13, 2000 (DE) ..... 100 12 193

(51) Int. Cl.[7] ..... A45D 1/02; A45D 6/06; A45D 1/04

(52) U.S. Cl. ..... 132/228; 132/227; 132/229

(58) Field of Search ..... 132/228, 227, 132/229, 272, 271; 126/409, 408

(56) References Cited

U.S. PATENT DOCUMENTS

| | | | | | |
|---|---|---|---|---|---|
| 4,248,208 | A | * | 2/1981 | Diederich | 126/409 |
| 4,341,229 | A | * | 7/1982 | Bauer et al. | 132/228 |
| 4,382,448 | A | * | 5/1983 | Tittert | 132/228 |
| 4,502,465 | A | * | 3/1985 | Yoshinaga et al. | 126/409 |
| 4,543,968 | A | | 10/1985 | Fukunaga et al. | |
| 4,924,849 | A | * | 5/1990 | Zaborowski | 126/409 |
| 5,394,862 | A | | 3/1995 | Firatli et al. | |

FOREIGN PATENT DOCUMENTS

| | | |
|---|---|---|
| DE | 2804426 C2 | 11/1987 |
| JP | 11046839 A | 2/1999 |

* cited by examiner

*Primary Examiner*—John J. Wilson
*Assistant Examiner*—Robyn Kieu Doan
(74) *Attorney, Agent, or Firm*—Fish & Richardson PC

(57) ABSTRACT

Steam styling tongs including an evaporating device which is supplied with heat by a heating device and comprises an evaporator surface in thermal contact with the heating device. Liquid evaporates on the evaporator surface into steam, which then passes into a steam-distributor chamber and, there, flows outward via through-passages. The heating device is formed in a combustion chamber of the drum, in which, during the heating operation, flame-free combustion of a gas takes place by means of a catalyst, of which the combustion gases pass out via outlets formed in the drum or in the combustion chamber. The combustion chamber and the steam-distributor chamber are formed by a common chamber. Means which prevent water from penetrating into the common chamber are also provided.

20 Claims, 4 Drawing Sheets

HAIR SHAPING DEVICE, ESPECIALLY A STEAM STYLING TONG

TECHNICAL FIELD

The invention relates to a hair-shaping appliance, in particular steam styling tongs.

BACKGROUND

JP-A-11 46839 discloses a gas-operated hair-shaping appliance, in which flame-free combustion of a gas takes place by means of a catalyst for heating up heating tubes in a combustion chamber. There is provided a steam-distributor chamber which is supplied with water by a liquid container. The liquid container is provided with an exchange valve, via which air flows in when water flows out of the liquid container. When not in use, the pressure in the liquid container can increase, for example, on account of heating. This may result in water passing, via the liquid-channeling device, into the steam chamber and, from there, then flowing into the steam-distributor chamber, where it ultimately passes outward via the through-passages. During the heating-up operation of the hair-shaping appliance, this may result in an increased formation of steam. Thus, a user may sustain burns if he/she picks up the appliance.

Outlets connected to the combustion chamber and through-passages connected to the steam-distributor chamber are formed in the drum. This may result in differing temperatures at various locations, since the temperature at the outlets is usually higher than the temperature at the through-passages. Furthermore, this hair-shaping appliance is expensive and complex to construct as a result of the combustion chamber being separated from the steam-distributor chamber.

An object of the invention is to develop a gas-operated hair-shaping appliance, in particular steam styling tongs, according to the preamble of patent claim 1 such that the above disadvantages are avoided and, at the same time, the construction and the assembly of the hair-shaping appliance are simplified and the production costs are reduced. Aspects of the invention are also intended to achieve uniform and/or freely selectable steam distribution over the circumference of the drum.

SUMMARY

In one aspect of the invention the steam can mix with the combustion gases coming from the catalyst to better effect in one common chamber and can heat up more uniformly. The steam and combustion gases pass out through commonly used through-passages, which may be formed uniformly around the drum. This results in a uniform hot stream of steam around the drum. In this way, the drum or the heating tube is also heated up better and more uniformly, because the common chamber can bound the drum all the way round from the inside. In order that no water passes into the common chamber, suitable means are provided according to an aspect of the invention. This is because if water droplets were to wet the catalyst, then considerable ignition problems would arise since a comparatively high level of ignition energy would have to be applied in order for the water located on the catalyst to be evaporated before the flame-free combustion process ignites the catalyst. A single collecting chamber for the combustion gases and the steam simplifies the construction of the hair-shaping appliance to a considerable extent and, in addition to the abovementioned advantages, reduces the production costs.

By virtue of the features of one embodiment, only through-passages are formed on the drum. The through passages are connected to the common chamber. Both the hot combustible gases and the steam pass through the through-passages, in the form of a mixture.

The features of another embodiment include means to prevent excess water from collecting in the evaporating device because, during the return stroke of the dosing device, the excess water is automatically sucked back into the liquid container. Even when the dosing device is actuated a number of times in quick succession, these actuations cannot result in the evaporating device overflowing since during the return stroke of the dosing or pumping device, on account of the "closed" liquid tank, excess water is always sucked back into the water tank via the liquid-channeling device. As a result of this embodiment of the invention, the appliance remains dry and no water can penetrate into the catalyst via the common chamber or pass out of the drum. Penetrating water would impair the functioning of the catalyst or would even prevent it from being ignited, since it would be necessary to first evaporate the water in the catalyst. The energy required to do this, however, is not present at the start of ignition.

According to the features of another embodiment, the dosing device comprises, on the one hand, a pressure/suction pump and, on the other hand, a closed liquid container with only one outlet. During the return stroke of the dosing or pumping device, the outlet performs the function of an inlet for excess water which collects in the evaporator chamber or still adheres to the liquid-channeling device as an excess droplet. Of course, it is also conceivable to integrate a further liquid container in the appliance, which is provided with a separately working liquid-channeling device that channels excess water back into the second container.

By virtue of excess liquid flowing back immediately into the liquid container from the evaporating device, the hair-shaping appliance can be held as desired in a user's hand without liquid passing out of the drum via the through-passages. This also results in a particularly economical water-discharging device. The liquid located in the liquid container is fully converted into steam without some of the water running out of the appliance unused.

The features of another embodiment are provided in order to improve the operation of the evaporating device further, and in order to prevent the water that is discharged by the dosing device during the actuation from escaping even when the hair-shaping appliance is in the horizontal position. The evaporator chamber forms a relatively large evaporating surface and, at the same time, it retains small water droplets to better effect. It is possible here for the chamber to be of plate-like, cup-like or pot-like design.

The features of another embodiment result in an embodiment of liquid-channeling device which does not expose the wick to an excessively high temperature. This increases the service life of the wick. It is thus no longer necessary for the wick to be pressed against the evaporating surface in order for water to be discharged in a metered manner. However, it is also possible, upon actuation of the dosing device, for the wick to come into contact with the evaporator plate and to be pressed against it slightly.

The features of another embodiment make it possible for the wick to transport both liquid and air in both directions. This arrangement allows straightforward metering of the liquid. It is not possible for the liquid to run out without the dosing device being actuated.

The features of another embodiment provide a large receiving surface for the liquid on the wick, with the result that, even when the liquid container is in the horizontal position, the wick is still supplied with sufficient liquid. This holds true even when the liquid container is almost empty.

The features of another embodiment render the distance between the free end of the wick and the evaporator-chamber surface small enough to enable, even in the case of a small droplet forming at the free end of the wick, for the droplet to come into contact with the evaporator-chamber surface and even to flow out onto the latter, and evaporate there.

The features of another embodiment bring about a particularly straightforward integration of the dosing device with the liquid container. Based on the piston stroke, a correspondingly large or small amount of liquid passes out of the liquid-channeling device. In the case of this arrangement, the piston has to be displaced automatically into its starting position, preferably by means of a spring, in order to enable an automatic suction stroke to be executed.

The features of another embodiment result in a particularly straightforward embodiment of the dosing device integrated in the liquid container. The elastically deformable wall can easily be actuated for discharging liquid; however, it also easily moves back automatically into its original shape again, on account of its elastic expandability, in order to allow the suction stroke to be executed without a user's intervention. The elastically deformable wall may be fastened on the liquid container, for example by injection molding, screw connection, adhesive bonding or in some other manner. It may also be designed as a molding with the liquid container. Although, in this case, the wall thicknesses should be coordinated with one another such that, upon actuation of the deformable wall, the liquid container itself hardly deforms.

In order that the dosing device can discharge considerable quantities of liquid, it is advantageous if the deformable wall is of an outwardly curved design. The elastically deformable material and the wall thickness of the deformable wall have to be selected such that, on the one hand, they can easily be moved by hand and, on the other hand, they produce a sufficient suction-stroke action in the chamber of the liquid container such that excess water, which may be present in the evaporating chamber or on the wick, can be sucked back into the liquid container sufficiently quickly via the liquid-channeling device.

The features of another embodiment are provided in order to ensure that water only flows into the evaporating chamber when the liquid-channeling device butts against the base of the evaporating chamber or, better, terminates a short distance in front of the chamber. The rigidity of the elastically deformable wall is thus selected to be high enough for the liquid container, initially without any marked elastic deformation of the wall, to be displaced counter to the force of the compression spring until the wick has reached its liquid-discharging position in the evaporating chamber. This ensures that even excess liquid which may occur during the return stroke can be channeled back into the liquid container via the wick. For easy displacement of the liquid container, the latter is fastened in a non-displaceable manner in an insulating sleeve, which is fastened in a stationary manner within the drum. In order to avoid thermal overloading of the liquid container, the insulating sleeve is preferably produced from plastic.

In another embodiment, in order to allow the deformable wall to be exchanged if it is worn, it may be connected to the liquid container by a thread, a clip device, or some other releasable connection.

The features of another embodiment are provided in order to enable the liquid container to be easily removed from the hair-shaping appliance to be filled with a liquid. The liquid container is preferably filled with water, water enriched with fragrances, hair-treating substances, or other materials. A locking device designed in accordance with the principle of a bayonet closure allows the liquid container to be quickly inserted and removed. In the locked position, the locking device releases the liquid container for further displacement in the direction of the evaporating chamber. At least one stub projecting radially on the liquid container initially engages in a recess, when inserted, and is then secured by rotation against dropping out automatically. The liquid container can be moved back and forth within certain limits in the longitudinal direction by means of a further recess adjoining the first recess. Instead of one stub, of course, it is also possible for two or more stubs to be formed on the circumference of the liquid container. Although, in this case, it is also necessary to introduce into the sleeve a corresponding number of recesses, which then cooperate with the respectively associated stub. This improves the guidance of the liquid container.

The features of another embodiment ensure that it is only when the liquid container has been removed from the hair-shaping appliance and the closure cap has been opened that it can be filled with water. The operation of removing the liquid container from the hair-shaping appliance, which is necessary for filling the liquid container, helps to prevent malfunctioning of, and thus possible damage to, the hair-shaping appliance, because a user is not required to hold the entire appliance under a water source during the filling operation. The forced separation of the liquid container from the hair-shaping appliance facilitates handling of the filling operation.In this case, the hair-shaping appliance can be set to one side and the liquid container, on account of it being smaller than the rest of the hair-shaping appliance, can be held more easily under a faucet or a container.

The features of another embodiment ensure that, following actuation of the dosing device, the liquid container is automatically moved back into its starting position by the force of the compression spring as soon as the actuating force applied to the elastic wall by a user decreases.

According to the features of another embodiment, the compression spring, in addition to serving as a restoring spring for the liquid container, also performs a retaining and sealing function. A sealing ring mounted on an external diameter of the compression spring butts with sealing action against the liquid container and seals the evaporator chamber in relation to the bore formed in the insulating sleeve and to the liquid container. The sealing ring butts with sliding action in the bore of the insulating sleeve to seal the evaporator chamber when the liquid container is displaced.

The features of another embodiment ensure that, if a water droplet is actually slung out of the evaporator chamber, it is stopped on the hot felt ring where it evaporates and then penetrates the felt ring in the form of steam. This prevents the functioning of the catalyst from being disturbed.

DETAILED DESCRIPTION

Figure 1:
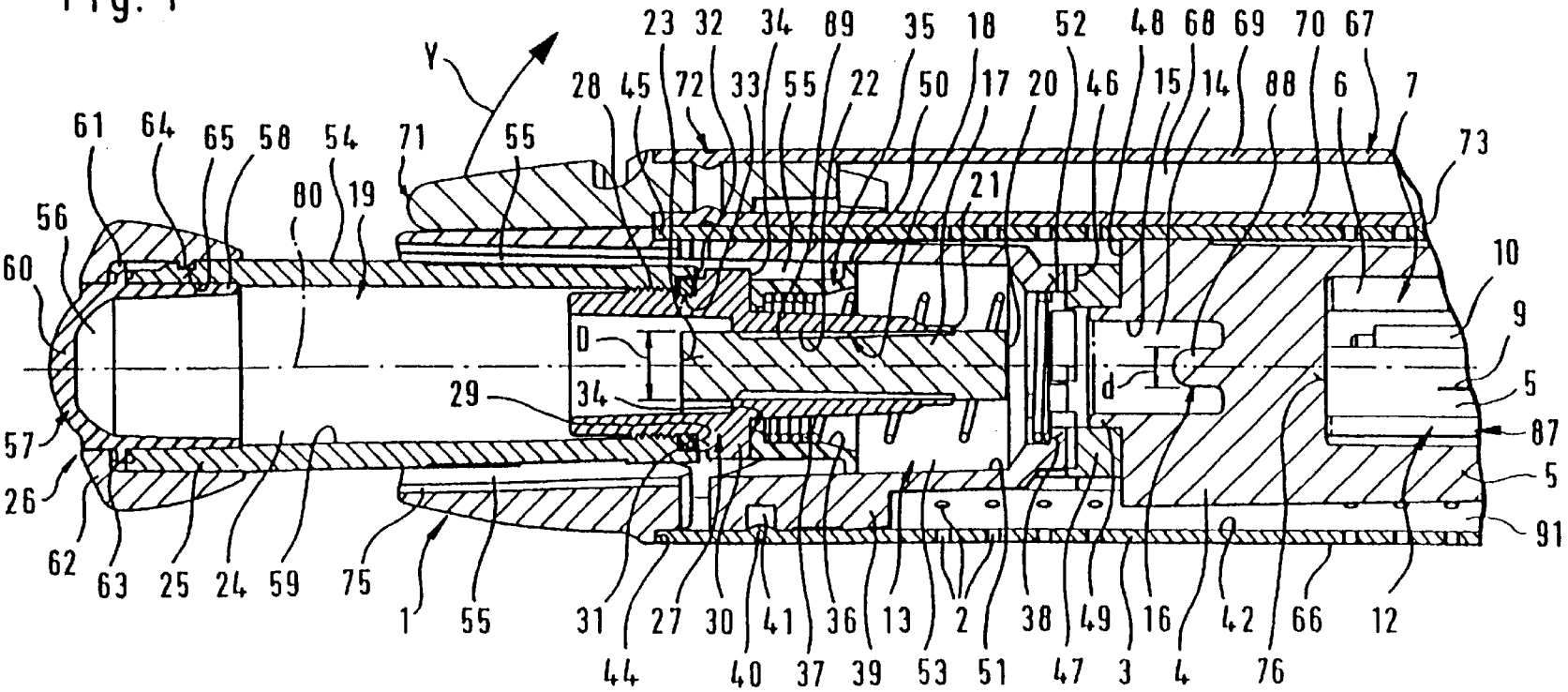
FIG. 1 shows, on an enlarged scale, a partial longitudinal cross-section of a front region of a hair-shaping appliance according to an embodiment of the invention with the dosing device being located in its non-actuated, starting position.
Figure 3:
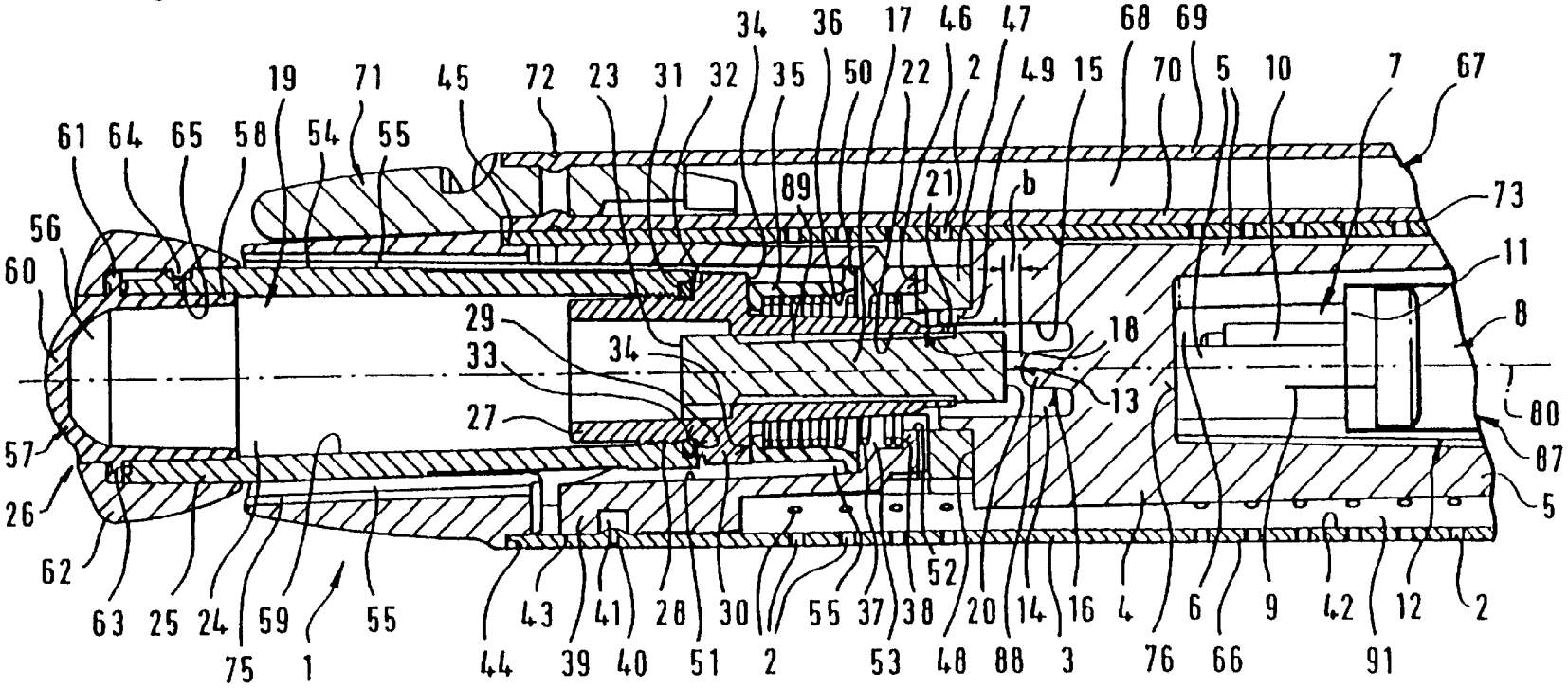
FIG. 3 shows a partial longitudinal cross-section through the hair-shaping appliance according to an embodiment of the invention corresponding to FIG. 1, with the dosing device in the actuated position.

The hair-shaping appliance 1, which is preferably designed in the form of steam styling tongs, comprises, according to FIGS. 1 and 3, a tubular drum 3, which treats hair (not illustrated). The tubular drum 3 includes through-passages 2. In a central section of the drum 3, there is formed an evaporator plate 4, which, according to FIGS. 1 and 3, has diametrically opposite crosspieces 5 which run to the right. Openings 6 are formed between the crosspieces 5. The crosspieces 5 enclose a combustion chamber 7, in which a tubular catalyst 8 is formed as part of a heating device 12. Flame-free combustion of a gas (not illustrated) takes place during the heating operation within the combustion chamber 7. The gas passes out of an outlet-valve device (not illustrated) of a cartridge (not illustrated) and flows into a mixing/regulating and valve device (not illustrated).

The catalyst 8 essentially comprises a tubular steel mesh with a surface coating which consists of platinum or palladium and on which the flame-free combustion takes place. Projecting at a free end 11 of the catalyst 8 are thin ignition filaments 9 which are produced from wire. The filaments 9 provide for easy ignition during start-up of the catalyst 8 and, thus, initiate the heating operation of the heating device 12. Projecting into the opening 6 from right to left is a control rod 10, which, based on the temperature, controls the feed of gas to the catalyst 8 via a valve device.

Opposite a base 76 of the opening 6, an evaporating device 13 is arranged within the drum 3. The evaporating device 13 includes an evaporator chamber 14, designed as a blind bore 15, with an evaporating surface 16. The evaporator chamber 14 is part of the evaporator plate 4 and likewise runs concentrically in relation to the drum 3. In addition, the evaporating device 13 preferably includes a felt or a similar air-permeable and water-permeable wick material fastened in an outlet 18 of a liquid container 19 to form a liquid-channeling device or wick 17. A first free end 20 of the wick 17 projects at a border 21 of the outlet 18. The wick 17 is compressed by the wall of a bore 22 firmly enough in order to be retained in a non-slip manner in the bore 22 of the outlet 18. The wick 17 has a second free end 23 projecting into a liquid-accommodating, preferably water-accommodating, chamber 24 of the liquid container 19 in order to form a sufficiently large receiving surface for the liquid.

According to FIGS. 1 and 3, the liquid container 19 comprises a tube 25, of which an outer end is provided with a dosing device 26, while its other end, which is located in the drum 3, is provided with a sleeve 27 on its base. The outlet 18 with the wick 17 is arranged in the sleeve 27. The sleeve 27 projects into the tube 25 and is preferably screw-connected there with sealing action by means of a thread 28 or a bayonet closure (not illustrated). The sleeve 27 has a projecting annular collar 30. An annular surface 29 of the annular collar 30 is directed toward the dosing device 26 and supports an O-ring 31. The O-ring is pressed against a free end 32 of the tube 25 to produce a sealed connection between the sleeve 27 and the tube 25. The O-ring 31 is retained in a stationary manner in an annular groove 33 formed in the sleeve 27. This prevents the O-ring 31 from sliding down the sleeve 27 when the liquid container 19 is unscrewed to be filled. Sliding down of the O-ring 31 could cause the O-ring to go missing, thereby eliminating the seal of the liquid container 19.

According to FIGS. 1 and 3, a sealing ring 35, in a bore 36 of which a compression spring 37 is retained in a stationary manner, is supported on an end surface 34 of the annular collar 30. The end surface 34 is directed toward the evaporator chamber 14. The compression spring 37 has its other end supported on a base 38 of an insulating sleeve 39. The sealing ring 35 is preferably produced from elastomeric material and, by way of its annular sealing surface 50, slides, with sealing action, along an inner bore 51 of the insulating sleeve 39. At the same time, the other end of the guide sleeve 35 butts with sealing action against the end surface 34, causing an annular chamber 53, which is connected to the evaporator chamber 14 via a bore 52, to close with sealing action in the direction of the atmosphere. This is because an annular space 55 is provided between an outer surface 54 of the tube 25 and the inner bore 51. This makes it possible for air to pass to the sealing surface 50 of the guide sleeve 35 via the annular space. The annular space 55 may be of very small dimensions in order to ensure tilting-free guidance of the liquid container 19 in the insulating sleeve 39.

Figure 2:
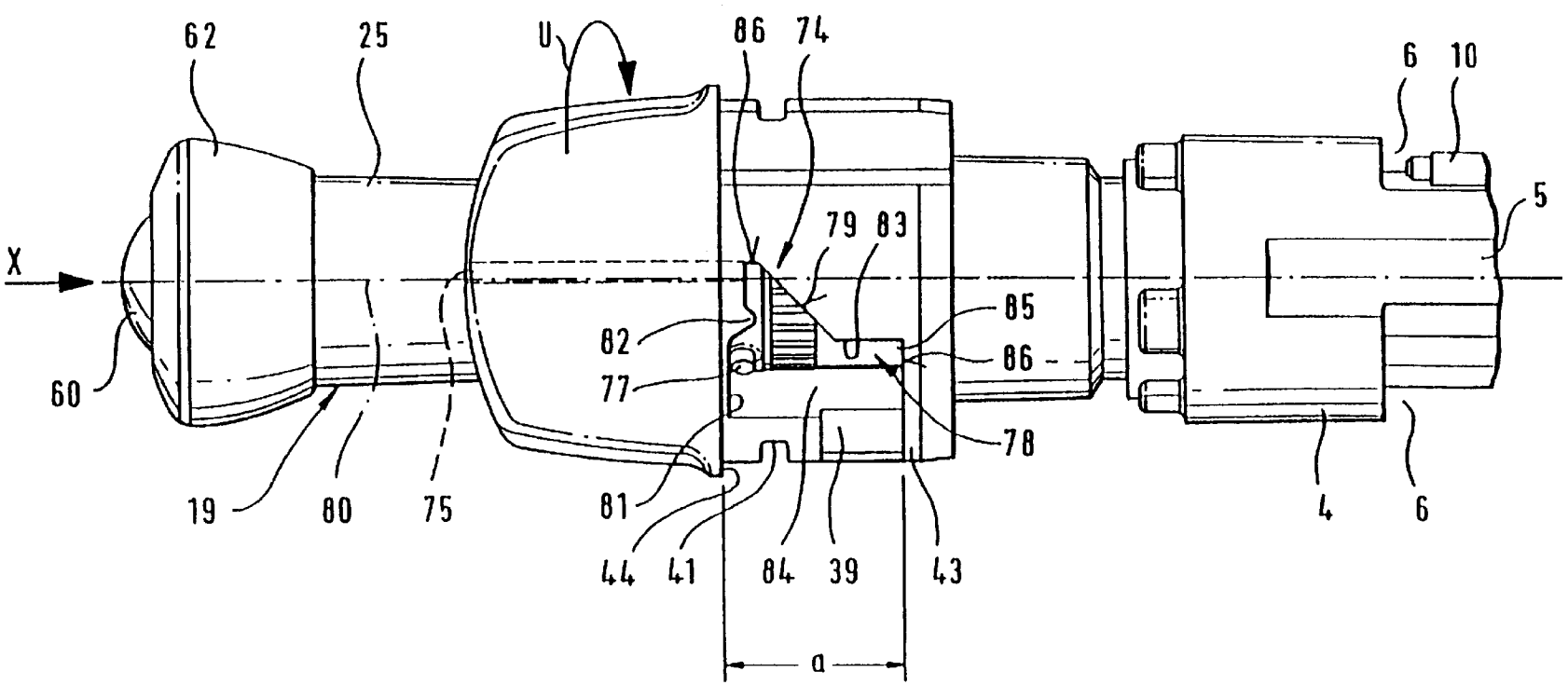
FIG. 2 shows a side view of a rotated portion of the hair shaping appliance including the insulating sleeve with the dosing device inserted therein and the evaporator plate before the portion is inserted into the drum.
Figure 4:
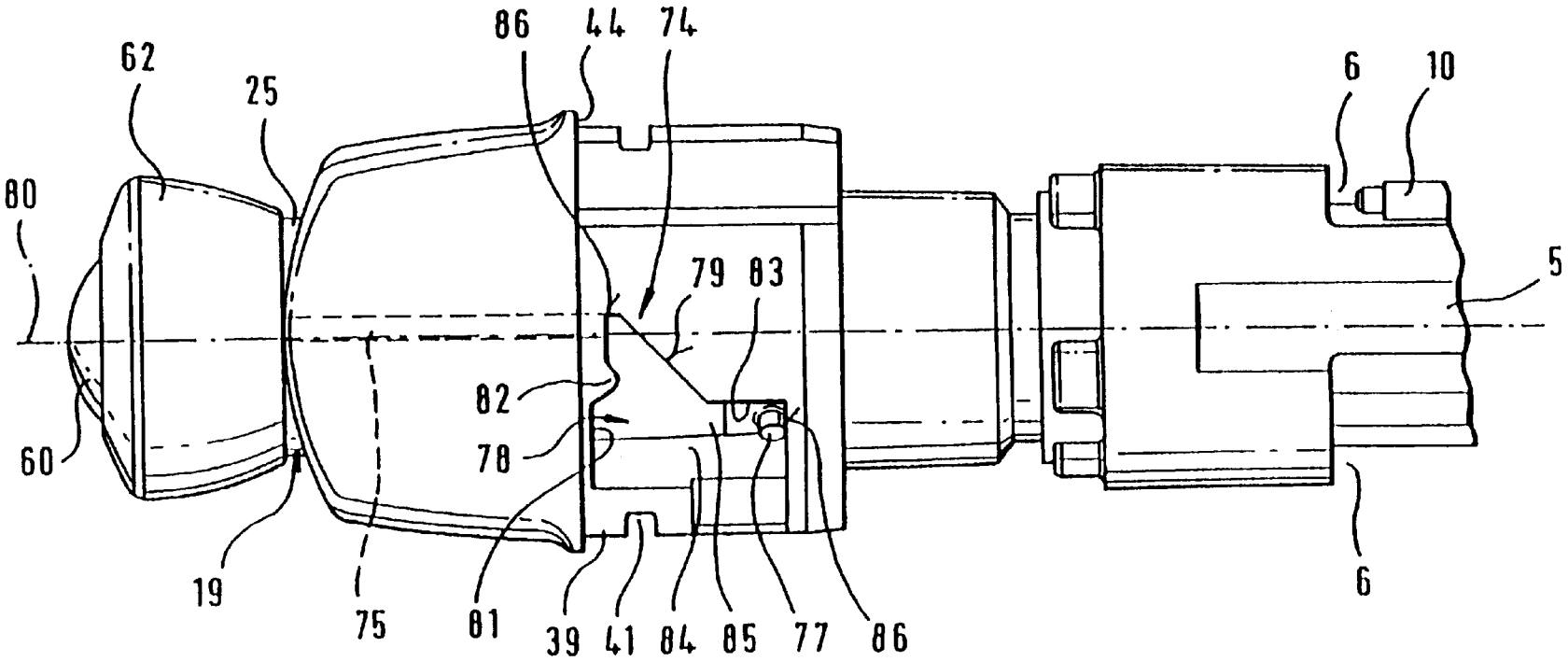
FIG. 4 shows a side view of the insulating sleeve with dosing device and evaporator plate according to FIG. 2, with the dosing device in the actuated position according to FIG. 3.

According to FIGS. 1 and 3, the insulating sleeve 39 is firmly connected to the drum 3, preferably by crimping. During the crimping, material 40 of the drum 3 is pressed plastically into depressions 41 formed on the insulating sleeve 39. FIGS. 2 and 4 show the insulating sleeve 39 before it is inserted into a bore 42 of the drum 3 and crimped. The insulating sleeve 39 is centered in the bore 42 by way of its outer surface 43 and strikes against the free end 45 of the drum 3 by way of its end surface 44. Thus, the insulating sleeve 39 always has a fixed arrangement in relation to the drum 3. The insulating sleeve 39 concentrically encloses part of the liquid container 19, the sleeve 27, and the evaporating device 13.

Supported, according to FIGS. 1 and 3, on an annular surface 46 of the insulating sleeve 39 is an annular felt element 47. An opposite side of the annular felt element 47 butts against an annular surface 48 of the evaporator plate 4. The annular felt element 47 is clamped in between the two annular surfaces 46, 48 such that it always maintains this position in captive fashion. In order for it to be centered in the radial direction, an annular collar 49 projecting from the annular surface 48 engages on an inner surface of the felt element 47. An end of the tube 25 which projects to the left out of the insulating sleeve 39 is provided with an opening 56, which is closed by a stopper 57. A cylindrical section 58 of the stopper 57 projects into a through-passage bore 59 of the tube 25 and is centered there. A base 60 of the stopper 57 is formed by a flexible diaphragm. Upon actuation of the stopper 57, for example by a user's finger applying pressure to it from the outside, the diaphragm deforms in the direction of a chamber 24 such that the chamber 24 is reduced in size and liquid is delivered into the evaporator chamber 14 via the wick 17.

An annular collar 61 is formed on the outer surface of the stopper 57 and is pressed with sealing action, by a retaining ring 62, into abutment against an end surface 63 formed at the free end of the tube 25. The retaining ring 62 itself is firmly connected to the tube 25 by retaining noses 64, which engage resiliently in latching holes 65 formed on the outer surface of the tube 25. This connection constitutes a type of clipping or snap-in device, in which the annular collar 61 is elastically deformed until the retaining noses 64 spring resiliently into the latching holes 65. Thus, in the manner of a barb, the retaining noses 64 are not capable of sliding out of the latching holes 65. The opening 56 of the tube 25 is closed with sealing action in this way. The diaphragm 60 and the cylindrical section 58 of the stopper 57 are preferably formed integrally from an elastic polymer material. The diaphragm 60 forms the pressure/suction pump and/or the dosing device 26 for the liquid container 19.

As shown in FIGS. 1 and 3, a clamp 67, which is generally customary in the case of such hair-shaping appliances 1, butts against an outer lateral surface 66 in a top region of the drum 3. The clamp 67 may be pivoted upward, in arrow direction Y, by hand on the right-hand side, about a point of rotation (not illustrated), in order to allow hair (not illustrated) to be wound around the outer lateral surface 66 of the drum 3. The hair is then clamped in between the outer lateral surface 66 and the clamp 67 by the downwardly moving clamp 67. The clamp 67 is of double-walled design. At its free end, the clamp 67 is closed in the forward direction by a stopper 71 engaging in a cavity 68 of its walls 69, 70. The stopper 71 is preferably firmly connected to the walls 69, 70 by a crimping device 72. The clamp 67 runs concentrically in relation to the outer lateral surface 66 of the drum 3, as seen in cross section. Thus, the clamp 67 butts against the outer lateral surface 66 if there is no hair positioned in a gap 73. In this position, the clamp 67 is more or less flush against the outer lateral surface 66. The width of the gap 73 is at its smallest in this position.

FIGS. 2 and 4 illustrate the dosing device 26 the liquid container 19, the insulating sleeve 39 and the evaporator plate 4. These are illustrated as an installation part which has been removed from the drum 3 in order to more clearly show a bayonet closure 74 between the liquid container 19 and the insulating sleeve 39. Formed on the inner bore 51 of the insulating sleeve 39, in the front left-hand section according to FIGS. 1 to 4, are diametrically opposite guide or insertion grooves 75 (illustrated by dashed lines in FIGS. 2 and 4). When the liquid container 19 is inserted into the insulating sleeve 39, diametrically opposite stubs 77, which project from an outer surface 54 of the tube 25, engage the insertion grooves 75. Following further displacement of the liquid container 19 according to FIGS. 1 to 4 to the right, the stubs 77 engage in a recess 78 formed on the insulating sleeve.

Upon further displacement in the direction X, the stub strikes against a ramp 79 of the recess 78 and, since the insulating sleeve 39 is fastened in a rotationally fixed manner in the drum 3, the tube 25, and thus the entire liquid container 19, is rotated in the direction of rotation U, (which runs in the clockwise direction). Upon release, the liquid container 19, with the stub 77, is moved longitudinally parallel to the center axis, counter to the displacement direction X and without rotating, by the force of the compression spring 37 until the stub 77 strikes against a stop surface 81 of the recess 78. This can be seen from FIG. 2. In this case, the stub 77 engages behind a blocking protuberance 82, which is formed on the stop surface 81. This prevents the liquid container 19, for example on account of vibrations acting on it, from being able to rotate automatically counter to the direction of rotation U, in which case the stub 77 could reach the guide groove 75 and drop out of the insulating sleeve 39. The compression spring 37 thus always presses the liquid container 19, and thus the stub 77, with prestressing against the stop surface 81.

According to FIGS. 2 and 4, the ramp 79 is adjoined by an end surface 83 which runs parallel to a center axis 80. With a boundary surface 84 located opposite the ramp 79 and the end surface 83, a gap 85 is formed in the recess 78. Upon axial displacement of the liquid container 19 in the direction X, the stub 77 can engage until it strikes against a stop surface 86 and no further displacement of the liquid container 19 is possible, as FIG. 4 clearly shows. In this position, the free end 20 of the wick 17 terminates at a small distance in front of the evaporator surface 16. The distance is preferably only a few millimeters. It is also conceivable, however, for the free end 20 of the wick 17 to strike against the evaporator surface 16 even in the actuating position illustrated in FIGS. 3 and 4.

Operation and functioning of the hair-shaping appliance 1 according to the invention are as follows:

1. Removal of the liquid container 19 from the hair-shaping appliance 1 and filling of said container with a liquid, preferably water:

According to FIG. 2, the retaining ring 62 is pressed firmly by hand in the actuating direction X such that the liquid container 19 is displaced to the right counter to the force of the compression spring 37. The stub 77 lifts off from the stop surface 81 in the process. At the same time, the liquid container 19 is rotated in the circumferential direction U by hand until the stub 77 strikes against the boundary surface 86 of the recess 78 and is aligned with the guide groove 75. On account of the prestressed compression spring 37, when the hand is released from the retaining ring 62 and/or the diaphragm 60 of the liquid container 19, the latter is displaced counter to the direction X and the stub 77 slides to the left in the guide groove 75 according to FIG. 2. As soon as the prestressing force of the compression spring 37 has been used up, the liquid container 19 can then be removed by hand from the inner bore 51 of the sleeve 27 and, thus, from the drum 3. The removed liquid container 19 comprises the dosing device 26, the tube 25, the sleeve 27, the O-ring 31, and the wick 17. The compression spring 37 remains, with the sealing ring 35, in the inner bore 51 since the right-hand end of the compression spring 37 has been pressed slightly into the bore 52 of the sleeve 27. The other end of the compression spring 37 is seated in the bore 36 of the sealing ring 35, with a small amount of prestressing. This also secures the sealing ring 35.

The removed liquid container 19 (not illustrated) can then be opened by the sleeve 27 being unscrewed from the thread 28. In this case, the O-ring 31 remains seated firmly in the groove 33 and, thus, cannot go missing. The same applies to the wick 17, which has been inserted into the bore 22 under prestressing. This is also shown by individual ribs 89 projecting in the bore 22. The tube 25 with its dosing device 26 can then be held under a faucet or a liquid-discharging location (not illustrated) and the tube 25 can be filled with a liquid via a freed through-passage bore 59. The sleeve 27 is then screwed to the tube 25 again until such time as the O-ring 31 butts in a pressure-tight manner against the free end 32 of the tube 25. In this position, liquid can pass outward only via the wick 17.

2. Insertion of the liquid container 19 into the hair-shaping appliance 1:

The liquid-filled liquid container 19, according to FIG. 1, is inserted into the inner bore 51 of the insulating sleeve 39 with the wick 17 in front. It is necessary to ensure that the stub or stubs 77 engages/engage in the guide grooves 75. In this position, the liquid container 19 is not initially rotatable. The liquid container 19 is then pushed into the insulating sleeve 39 until the stub or stubs 77 strikes/strike against the ramp or ramps 79. Upon further displacement of the liquid container 19 in the direction X, the container is automatically rotated counter to the direction of rotation U by the stubs 77 sliding up the ramp 79. When the liquid container 19 is pushed into the insulating sleeve 39, the end surface 34 of the sleeve 27 strikes against the end surface 34 of the sealing ring 35 and, upon further displacement of the liquid container 19 in the direction X, the sealing ring 35 is carried along to the right and the compression spring 37 is prestressed in the process. It should be noted, at this stage, that two bayonet closures 74 may be formed diametrically opposite one another, for better centering of the liquid container 19, in the insulating sleeve 39.

Once the liquid container 19 has been rotated to a sufficient extent, and the compression spring 37 has been prestressed to a correspondingly high level, the manual force acting on the liquid container 19 can then decrease to the extent where the force of the compression spring 37 displaces the liquid container 19 counter to the direction X again until the stub 77 engages behind the blocking protuberance 82 and strikes against the stop surface 81. Once this occurs, the position of the liquid container 19 according to FIGS. 1 and 2 has been reached and the hairshaping appliance 1 is then ready for operation.

3. Operation of the hair-shaping appliance according to the invention during the discharge of steam:

Once a valve device (not illustrated) has been rotated into its open position by hand, gas flows into the catalyst 8 and it is likewise possible, by activating a further ignition button (not illustrated), for the ignition device (not illustrated) to be ignited. On account of a combustion, the ignition filaments 9 achieve their operating temperature, i.e. they begin to ignite by the flame-free combustion. This high temperature is then transmitted to the catalyst 8, which is activated in this way.

The evaporator plate 4 is then heated until the control rod 10 cuts back the gas feed. The desired operating temperature at the evaporator plate 4 is then automatically controlled by the control rod 10 by virtue of opening and closing the valve device. The heat of the catalyst which is produced in the combustion chamber 7 also penetrates, via the openings 6 (FIGS. 2 and 4), into a common chamber 87 formed between the evaporator plate 4 and the bore 42 of the drum 3. This results in the bore 42 and, thus, the drum 3, also being heated. According to an aspect of the invention, the common chamber 87 combines the combustion chamber 7 with the steam distributor chamber 91. The combustion gases produced in the catalyst 8 are delivered, via the openings 6, into the common chamber 87 and, from there, to the outside via the through-passages 2. This operation takes place until such time as the hair-shaping appliance is sufficiently hot.

A user can then pick up the hair-shaping appliance 1 by its handle (not illustrated). The handle is formed on the right-hand side of the hair-shaping appliance 1 according to FIGS. 1 to 4. The user may move the appliance 1 toward his/her head. The clamp 67 may be pivoted open and hair may be positioned in the resulting gap 73. It is then possible for the hair to be wound around the outer lateral surface 66 of the drum 3.

A user can then use a finger of his/her other hand (not illustrated) to press on the base 60 of the dosing device 26 until such time as the liquid container 19 is displaced in the direction X counter to the force of the compression spring 37. In this actuating position, the base 60 of the diaphragm hardly deforms at all since the deformation force which is necessary for deforming the base 60 is greater than the force which is necessary for compressing the compression spring 37. This means that the liquid container 19 is displaced in the direction X, counter to the compressive force of the compression spring 37, until such time as the stub 77 strikes against the boundary surface 86 of the recess 78, as can clearly be seen in FIG. 4 in particular.

If force then continues to be applied to the base 60 of the dosing device 26, the base 60 deforms into the through-passage bore 59 of the tube 25 (although this is not illustrated in the drawing). With this deformation of the base 60, the liquid located in the liquid container 19 is then forced through the wick 17 causing liquid in the form of droplets (not illustrated) to pass through the free end 20 of the wick 17. Since there is only a very small distance "b" between the free end 20 of the wick 17 and the evaporator surface 16 in this position (FIG. 3)—the distance being approximately 1 to 5 mm—the droplet comes into contact with the evaporator surface 16. The droplet, therefore, evaporates, before it can drop off the wick 17. If the base 60 is pressed firmly enough for a plurality of liquid droplets to pass out at the free end 20 of the wick 17, then the evaporator chamber 14 is filled to a greater or lesser extent with liquid. The liquid can then partially or wholly evaporate, provided that pressure continues to be applied to the base 60 of the dosing device 26.

The steam formed in the evaporator chamber 14, according to FIGS. 1 and 3, is then guided into the annular chamber 53 where it penetrates the annular felt element 47. Water droplets are restrained by the felt element 47 or wick 17. Steam and water cannot pass into the annular space 55, which is open to the atmosphere, since the sealing ring 35 is sealed in relation to the inner bore 51 and the sleeve 27. Once the steam has penetrated the felt element 47, it passes into the steam-distributor chamber 91 and, thus, [according to the invention] also into the common chamber 87. The steam is heated up there again and leaves the through-passages 2 in the outward direction together with the combustion gases. This steam penetrates into a user's hair, heats the hair and, at the same time, wets it so that it can be shaped to better effect.

As soon as the pressure on the base 60 of the dosing device 26 decreases to a point that the pressure is smaller than the force applied by the compression spring 37, the liquid container 19 is displaced to the left, counter to the direction X, until, in turn, the stub 77 strikes against the stop surface 81. When the force is removed from the base 60, the base 60 deforms again into the starting position illustrated in FIGS. 1–4. A negative pressure is produced in the chamber 24 of the liquid container 19 ensuring that the excess liquid in the wick 17 and/or in the evaporator chamber 14 (that is to say liquid which has not yet been converted into steam), is sucked back into the chamber 24 via the wick 17. This prevents any more liquid from being evaporated than is desired by a user.

Through the actuation of the base 60 of the dosing device 26, it is very difficult to meter the precise quantity of water which is to be evaporated in the evaporator chamber 14. For this reason, it is possible, if too much liquid has passed into the evaporator chamber 14, for example, on account of excessively pronounced actuation of the base 60 and/or of the dosing device 26, for the liquid to be sucked back abruptly into the chamber 24 of the liquid container 19 via the wick 17. (In this case, the steam delivery is adjusted in an abrupt manner.) This produces a hair-shaping appliance 1 with very economical water consumption for producing steam.

(When the hair-shaping appliance 1 is not in use) and when the hair-shaping appliance 1 is not used for a relatively long period of time, it is not possible for the liquid, which is still located in the chamber 24 of the liquid container 19, to run out of the latter and pass out as non-evaporated water at the through-passages 2 or even to be able to pass to the catalyst 8 via the openings 6. The latter possibility would render the next ignition operation difficult, or would even make it impossible to activate the catalyst 8. For this purpose, an excessively high level of ignition energy would be necessary in order to drive the liquid out of the catalyst 8.

According to an aspect of the invention, it is, thus, not possible for the liquid to run out of the liquid container 19 because the dosing device 26 closes the liquid container 19 with sealing action. The liquid can only run out via the wick 17 when the dosing device 26 is actuated and, during the return stroke, air flows into the liquid container 19 via the wick 17. Since, however, the wick 17 is dimensioned such that, in the pressure-free state, no air can penetrate into the chamber 24 via the same, it is not possible for any liquid to run out of the liquid container 19 without external action.

When the liquid tank 19 is displaced, the base 60 is merely subjected to an axially directed force applied by hand. Rotation and, thus, the possibility of the liquid container 19 dropping out of the hair-shaping appliance 1 when the force is released are barely possible. The maximum displacement of the liquid container 19 is provided by the distance (a) between the stop surface 81 and the boundary surface 86. This precisely defines the minimum distance (b) between the free end 20 of the wick 17 and the evaporator surface 16 (FIG. 3).

It should also be mentioned that the evaporator surface 16 is provided with a stub-like elevation 88, of which the average diameter (d) is smaller than the diameter of the free end 20 of the wick 17 (FIG. 1). Furthermore, the stub-like elevation 88 is rounded at its free end in order for the wick 17 to be subjected to the action of as little heat as possible. This increases the service life of the wick 17. The stub-like elevation 88 also advantageously serves to provide the largest possible evaporator surface 16, by means of which the largest possible quantity of steam can be produced in a comparatively short period of time.

Once a curl (not illustrated) has been sufficiently subjected to the action of steam and heat, and has thus achieved a comparatively stable form, the clamp 67 can be opened by hand and the curled sections of hair can be removed from the hair-shaping appliance. The operation can then be repeated on further sections of hair.

What is claimed is:

1. A hair-shaping appliance, in particular steam styling tongs, having a tubular drum which treats the hair and is provided with through-passages, having a dosing device, upon the actuation of which liquid passes out of an outlet of a liquid container via a liquid-channeling device, and having an evaporating device which is supplied with heat by a heating device and comprises an evaporator surface which is in thermal contact with the heating device and on which liquid which has passed out evaporates into steam, which then passes into a steam-distributor chamber and, there, passes outward via the through-passages, the heating device being formed in a combustion chamber of the drum, in which, during the heating operation, flame-free combustion of a gas takes place by means of a catalyst, of which the combustion gases pass out via outlets formed in the drum and/or in the combustion chamber, characterized in that the combustion chamber and the steam-distributor chamber are formed by a common chamber, and in that means which prevent water penetrating into the common chamber are provided.

2. The hair-shaping appliance as claimed in claim 1, characterized in that the common chamber is bounded on the outside by the drum which, for its part, is provided with outlet holes which form both the through-passages and the outlets.

3. The hair-shaping appliance as claimed in claim 1, characterized in that the means are designed such that, as a result of the actuation of the dosing device, excess liquid which may be present in the evaporator chamber, before the next actuation of the dosing device in each case, to remove from the evaporator chamber again and to convey back into the liquid container.

4. The hair-shaping appliance as claimed in claim 3, characterized in that the means comprise the dosing device and the liquid-channeling device, in that the dosing device comprises, on the one hand, a pressure/suction pump operating in accordance with the displacement principle and, on the other hand, the liquid container, which can only be brought into connection with the atmosphere via its outlet, with the result that during the return stroke of the pressure/suction pump excess liquid flows back into the liquid container again, in reverse, via the liquid-channeling device.

5. The hair-shaping appliance as claimed in claim 4, characterized in that the evaporating device comprises an evaporator surface which is located opposite the outlet, and in that the evaporator surface is part of an evaporator chamber which receives and discharges the liquid.

6. The hair-shaping appliance as claimed in claim 4, characterized in that the liquid-channeling device comprises a wick which is fastened in the outlet and of which the first free end terminates at a small distance in front of the evaporator surface when liquid is discharged or received.

7. The hair-shaping appliance as claimed in claim 4, characterized in that the wick can transport both water and air in both directions of flow.

8. The hair-shaping appliance as claimed in claim 5 or 7, characterized in that the second free end of the wick projects into the liquid container.

9. The hair-shaping appliance as claimed in claim 5 or 7, characterized in that, for discharging liquid, the first free end of the wick is only spaced apart from the evaporator surface by the extent such that the quantity of liquid discharged during actuation of the pressure/suction pump is sufficient in order to form a droplet large enough, at the first free end of the wick, to produce contact with the evaporator surface.

10. The hair-shaping appliance as claimed in claim 4, characterized in that the dosing device and the chamber of the liquid container form a piston/cylinder arrangement.

11. The hair-shaping appliance as claimed in claim 4, characterized in that the dosing device comprises an elastically deformable wall which forms part of the liquid container.

12. The hair-shaping appliance as claimed in claim 11, characterized in that the liquid container can be displaced in the axial longitudinal direction of the hair-shaping appliance, counter to the force of a compression spring, in an insulating sleeve fastened in the drum in that the outlet with its liquid-channeling device is formed at that end of the liquid container which is located opposite the evaporator surface, and the deformable wall is formed at the other, remote end of the liquid container, and in that a marked deformation of the elastically deformable wall is only possible when the liquid container, once displaced, moves against a stop.

13. The hair-shaping appliance as claimed in claim 12, characterized in that the elastically deformable wall is arranged in a removable manner on the housing of the liquid container.

14. The hair-shaping appliance as claimed in claim 12, characterized in that at least one stub projects on the outer surface of the liquid container and, following the insertion of the liquid container, engages in a bayonet-like manner behind a recess formed on the insulating sleeve, and in that the recess is adjoined by a gap which runs in the longitudinal direction of the insulating sleeve and allows further displacement of the liquid container in the direction of the evaporator surface.

15. The hair-shaping appliance as claimed in claim 12, characterized in that the base of the liquid container is formed by a sleeve provided with the outlet, in that the liquid-channeling device is fastened in the outlet and projects out of the sleeve, and in that the sleeve is fastened releasably on a tube of the liquid container by means of a second releasable connection, preferably a bayonet closure or thread.

16. The hair-shaping appliance as claimed in claim 15, characterized in that formed on the outer wall of the sleeve is a stop on which the compression spring is supported on one side, and in that formed on the inner wall of the insulating sleeve is a base on which the other side of the compression spring is supported.

17. The hair-shaping appliance as claimed in claim 16, characterized in that mounted on the external diameter of the compression spring is a sealing ring, of which one end butts with sealing action against an end surface of the sleeve and the other end butts with sealing and sliding action against the inner wall of the insulating sleeve.

18. The hair-shaping appliance as claimed in claim 17, characterized in that the insulating sleeve is introduced into the drum to such an extent that a steam-permeable ring, preferably a felt element, is clamped in between the free end of the insulating sleeve and the end side of an evaporator chamber formed by the evaporator plate, with the result that the steam produced in the evaporator chamber can only pass into the common chamber via the steam-permeable ring.

19. The hair-shaping appliance as claimed in claim 12, characterized in that the base of the liquid container is formed by a sleeve provided with the outlet, in that the liquid-channeling device is fastened in the outlet and projects out of the sleeve, and in that the sleeve is fastened releasably on a tube of the liquid container by means of a second releasable connection.

20. The hair-shaping appliance as claimed in claim 17, characterized in that the insulating sleeve is introduced into the drum to such an extent that a steam-permeable ring is clamped in between the free end of the insulating sleeve and the end side of an evaporator chamber formed by the evaporator plate, with the result that the steam produced in the evaporator chamber can only pass into the common chamber via the steam-permeable ring.

* * * * *